US006428219B1

(12) United States Patent
Stier et al.

(10) Patent No.: US 6,428,219 B1
(45) **Date of Patent: *Aug. 6, 2002**

(54) BUSINESS COURTESY ENVELOPES

(75) Inventors: Mark A. Stier, Laguna Niguel; Keith Bussell, Los Angeles; Christopher Patrick Miller, Sherman Oaks, all of CA (US)

(73) Assignee: Stamps.com, Santa Monica, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/578,079

(22) Filed: May 23, 2000

Related U.S. Application Data

(63) Continuation-in-part of application No. 09/540,112, filed on Mar. 31, 2000, which is a continuation-in-part of application No. 09/439,531, filed on Nov. 12, 1999, now Pat. No. 6,244,763.

(51) Int. Cl.[7] ..... B41J 5/30
(52) U.S. Cl. ..... 400/76; 400/70; 400/61
(58) Field of Search ..... 400/76, 70, 61

(56) References Cited

U.S. PATENT DOCUMENTS

| | | | | | |
|---|---|---|---|---|---|
| 4,607,433 | A | * | 8/1986 | Meeker | 33/1 |
| 5,319,562 | A | * | 6/1994 | Whitehouse | 364/464.03 |
| 6,010,156 | A | * | 1/2000 | Block | 281/2 |
| 6,142,380 | A | * | 11/2000 | Sasone et al. | 235/487 |
| 6,173,888 | B1 | * | 1/2001 | Fabel | 229/71 |
| 6,209,920 | B1 | * | 4/2001 | Fabel | 283/62 |

* cited by examiner

*Primary Examiner*—Andrew H. Hirshfeld
*Assistant Examiner*—Charles H. Nolan, Jr.
(74) *Attorney, Agent, or Firm*—Christie, Parker & Hale, LLP

(57) ABSTRACT

A sheet or roll having at least one self-adhesive special purpose label arrangement set having a postage indicia label and optionally a sender label, and process for printing the special purpose label set or printing the postage indicia directly on upper right hand corner of a business courtesy envelope. The postage indicia label and the indicia printed thereon or directly onto the business courtesy envelope is sized and shaped so that the postage indicia will not impinge on the FIM pattern or the automated postage handling markings on the business courtesy envelope.

20 Claims, 7 Drawing Sheets

BUSINESS COURTESY ENVELOPES

CROSS-REFERENCE TO RELATED APPLICATION

This is a continuation-in-part application of application Ser. No. 09/540,112, filed Mar. 31, 2000 entitled "PC Postage Label Usable for Envelopes with Facing Identification Marks," which is a continuation-in-part of application Ser. No. 09/439,531, filed Nov. 12, 1999 now U.S. Pat No. 6,244,763 entitled "PC Postage Label Containing Three Primary Labels for Indicia, Sender and Recipient and Method for Printing Same," both of which are incorporated by reference herein.

BACKGROUND OF THE INVENTION

This invention is in the field of business courtesy envelopes, and more particularly is a special purpose label arrangement set and method for use in printing PC postage onto the labels or directly onto business courtesy envelopes.

SUMMARY OF THE INVENTION

The United States Postal Service (USPS) has responded to recent technological developments in the telecommunication and computer field by developing its Information Based Indicia Program (IBIP.) The IBIP involves the development of new technology to produce new forms of postage. In so-called PC Postage, a user can purchase postage credit, and print the postage in the form of PC Postage onto a label or directly onto the mail piece. The PC Postage includes a human readable portion and a 2-dimensional barcode portion. The human readable portion typically includes the postage value, mail class, the date, the meter number, optionally a logo and the destination zip code. The barcode portion is intended to help thwart fraud, and includes information about the mail piece including the destination ZIP code, the amount of postage applied, the date and time the postage was applied, and a digital signature so that the USPS can validate the authenticity of the postage.

In one preferred embodiment of PC Postage, a user will subscribe to a third party central server location, such as Stamps.com (of Santa Monica, Calif.), and by using postage software made available by the central server location, postage value can be downloaded to the user's computer. The user can then print the postage indicia, by an ordinary laser or ink jet printer, roll label-type printer, or other known printer, directly onto the mail piece itself (e.g. onto a business envelope), or onto a label to be applied to the mail piece. This postage software works in conjunction with other software programs, such as word processing, accounting, database, and contact management software to allow a user to conveniently print out PC Postage at the same time that addressee and bar code information is printed (and also the sender's return address.)

In order to permit the sophisticated mail handling and optical reading equipment at the USPS to properly interpret the PC Postage and addressee information, it is important that the postage indicia be applied properly. The USPS has established guidelines directed to the margins, label sizes, and placement of the Postage Indicia, and the size, placement, and other characteristics of the POSTNET (POStal Numeric Encoding Technique) bar codes, and any facing identification mark (FIM) on mail pieces. These guidelines are contained in the Domestic Mail Manual (DMM) and Title 39, Code of Federal Register (CFR), Part 111, and USPS Publication No. 25 "Designing Letter Mail".

A facing identification mark (FIM)is a mark printed on an envelope for facing purposes. A FIM may preferably be a pattern of vertical bars printed in the upper right area of the front side a mail piece, to the left of the indicia space for a stamp, metering or PC postage. A FIM pattern is essentially a nine-bit code consisting of bars and no-bar place holders (in which the bars corresponding to a binary 1 and no bars correspond to a binary 0.) FIM patterns serves two major purposes. The FIM patterns allow mailpieces that do not contain luminescent stamps or meter imprints (such as business reply mail and official government mail) to be faced (oriented) and canceled (postmarked) by USPS machinery. FIM patterns also permit business reply mail and courtesy reply mail to be separated from other letters and cards for direct processing by optical character readers (OCRs) or barcode sorters (BCSs). This helps in achieving faster processing times.

Other countries' posts have various other automated postage handling markings in lieu of FIM markings ("Automated postage handling markings".) The inventors anticipate that as foreign countries begin accepting PC postage, a need will arise for special purpose labels and processes for printing postage indicia directly onto the special purpose labels designed to work with envelopes bearing the automated postage handling markings.

There are presently four different FIM markings used in the U.S.A. FIM A is used for courtesy reply mail. FIM B is used for business reply mail, penalty mail, or franked mail without a POSTNET barcode. FIM C is used for business reply mail, penalty mail, or franked mail with a POSTNET barcode. In addition, FIM D is typically used for IBIP mailings, except that a FIM A is required when the FIM pattern is preprinted onto a business courtesy envelope. Notwithstanding which particular FIM pattern is applied, under USPS regulations, there are regulations and guidelines concerning the size and placement of the FIM pattern. Likewise, foreign countries have regulations concerning where the automated postage handling markings are placed.

The FIM pattern is printed in a FIM clear zone, in which no other printing may appear. The FIM clear zone is a rectangular sized zone extending from downwardly 0.625 inches from the upper edge of the mail piece and is located between 3 inches and 1.750 inches from the right side edge. The FIM bars must be 0.625 inch ±0.125 inch high and 0.03125 inch ±0.008 inch wide. The rightmost bar of the FIM must be 2 inches ±0.125 inch from the right edge of the mail piece. The tops of the FIM bars must be no lower than 0.125 inch from the top of mail piece and the bottoms of the FIM bars should touch the bottom edge of the FIM clear zone but must not be more than 0.125 inch above or below that edge.

In view of the presence of FIM patterns on business courtesy mail pieces, which can comprise a relatively large percentage of PC postage users' mailing needs, it would be useful to have PC postage labels and method for printing PC postage onto labels and directly onto envelopes that are designed for use with mail pieces with FIM patterns.

There accordingly are opportunities for IBIP vendors to extend their added value into the area of "Business Courtesy" mailings. Business Courtesy mailings can be referred to as pieces mailed in envelopes that are provided to a user by an outside business for the primary purpose of facilitating that user's payment of a bill or other response to the business. These mail items are not pre-paid by the business, and have a number of attributes, including the following. The destination address will typically be provided, either through a pre-printing on the envelope or by using a windowed envelope that exposes the destination address. The FIM pattern may or may not be preprinted onto the envelope. Where a FIM pattern appears, it is typically of the "FIM A" type. The return address may or may not be printed onto the envelope. Similarly, as such time as foreign countries adopt PC postage, so to will a need arise for PC postage solutions for business courtesy envelopes.

From a standpoint of the USPS IBIP vendors and customers, the ability to enable PC Postage for all of a customer's needs, including IBIP vendor support of business courtesy mail, is highly advantageous to PC Postage customer and provides customers with a complete postage solution.

DETAILED DESCRIPTION OF THE INVENTION

Figure 1:
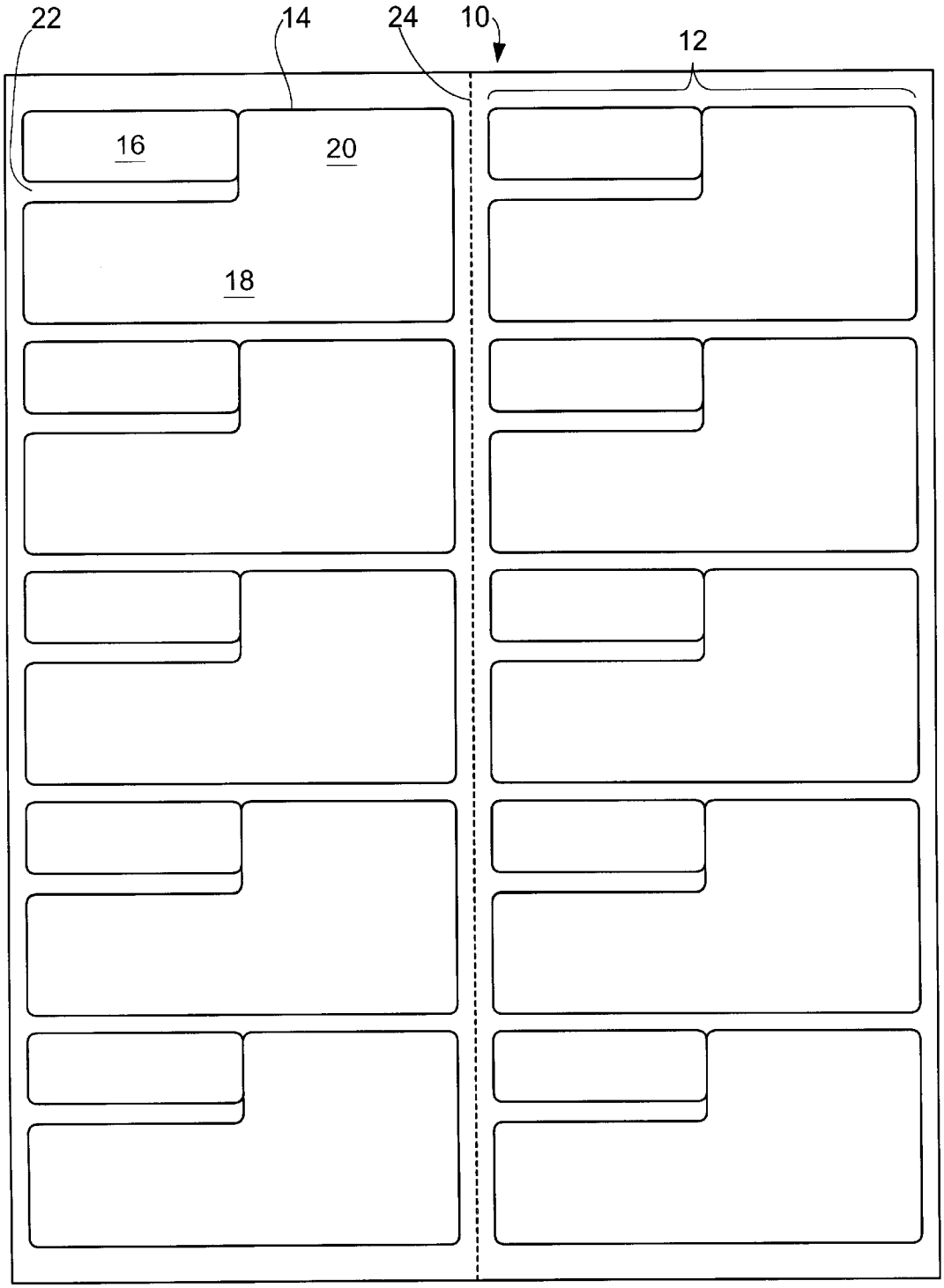
FIG. 1 is a plan view of a first embodiment of a sheet of unprinted self-adhesive label sets having an indicia label and a sender label.

Referring first to FIG. 1, there is shown a plan view of a first embodiment of a single sheet 10 of self-adhesive label sets 12 of the invention. Several sets 12 are shown as appearing on a single sheet 10, but single labels sheets could be provided (not shown.) Each label set 12 has a postage indicia label 14, and a sender label 16. The postage indicia label 14 is non-rectangular in shape and is well-suited for business courtesy envelopes bearing pre-printed FIM patterns (or automated postage handling markings.) The postage indicia label 14 has a wider lower rectangular section 18 and a narrower upper rectangular section 20, with the upper rectangular section 20 extending above the lower rectangular section 18 on the right hand side, with the result that a relief portion 22 is formed on its upper left hand side of postage indicia label 14. The sender label 16 can conveniently be located on the sheet 10 in the relief portion 22, but could be located on other places on the sheet 10 if desired. The smaller upper rectangular section 20 provides space for the postage indicia, yet does not overlay the FIM pattern (or automated postage handling markings) when the postage indicia label 14 is applied to a mailpiece, as will be discussed below.

The sizing of label arrangement set 12 for an 21.59 cm×cm 27.94 (8.5 inches×11 inches) sheet 10 can preferably be made as follows to maximize the number of labels on a sheet, yet provide sufficient printing area.

Postage indicia label 14 can have a total width of about 8.89 cm (3.5 inches) and a total height of about 4.45 cm (1.75 inches). The wider lower rectangular section 18 is about 8.89 cm (3.5 inches) wide and about 2.54 cm (1.00 inches) high, and the narrower upper rectangular section 20 is about 4.45 cm (1.75 inches) wide and about 1.91 cm (0.75 inches) high, again with the total height being about 4.45 cm (1.75 inches) . The sender label 16 can be about 4.45 cm (1.75 inches) wide and about 1.27 cm (0.5 inch) high, and can be positioned in relief area 22 with the right edge of sender label 16 contacting the left edge of the upper rectangular section 20. A set of ten label sets 12 can be carried on the sheet 10, with five sets on either side of a sheet, arranged in a portrait orientation. Sheet 10 can be bisected by a dividing line 24.

Figure 2:
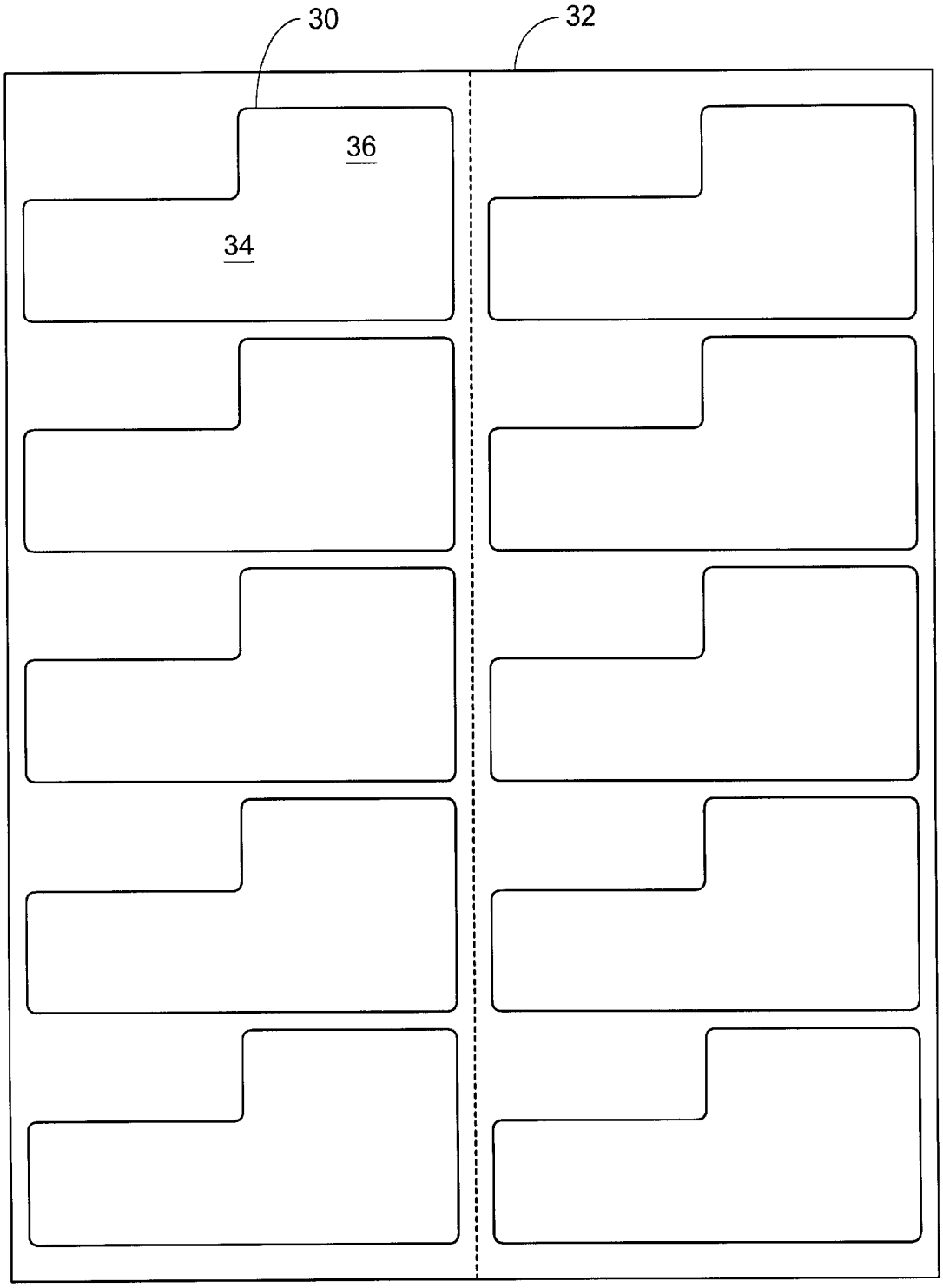
FIG. 2. is a plan view of a second embodiment of a sheet of unprinted self-adhesive label sets of the invention including self-adhesive postage indicia labels.

Turning now to FIG. 2, there is shown a second embodiment of a sheet of self-adhesive labels 30, which is identical to that of FIG. 1 in that it includes a number of non-rectangular postage indicia labels 30 on a sheet 32. The postage indicia labels 30 have a larger lower portion 34 and a smaller upper portion 36. However, no sender label portion is included.

Figure 3A:
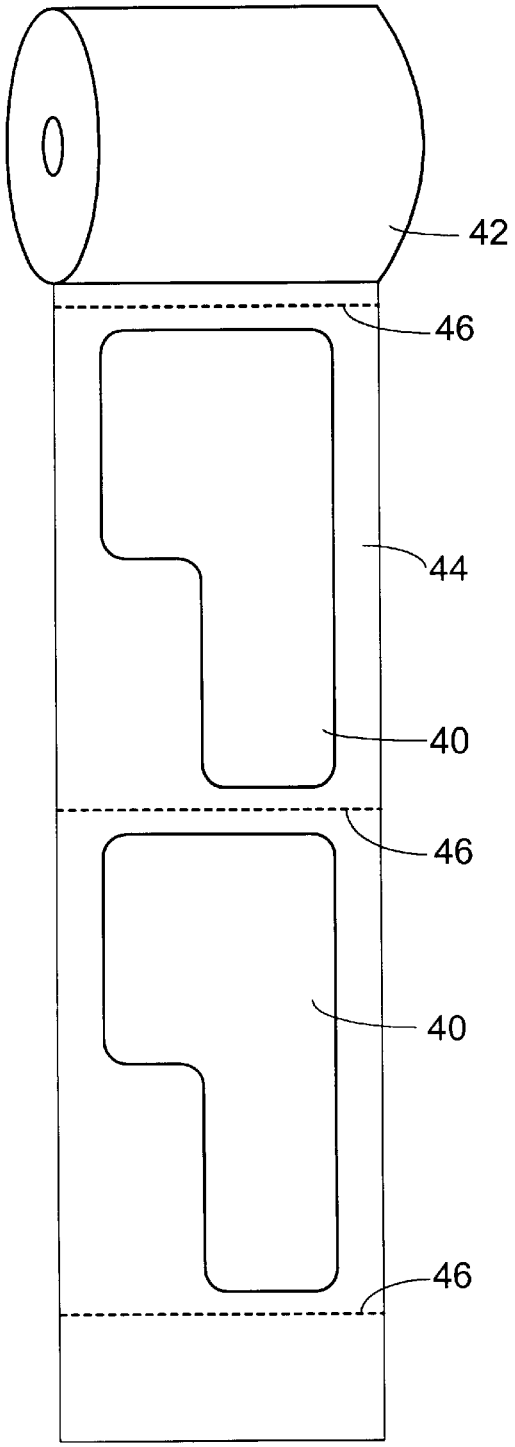
FIG. 3A is a top view of a third embodiment of unprinted self-adhesive label set of the invention in a roll format including postage indicia labels.

Referring to FIG. 3A, there is shown a top view of a third embodiment of unprinted self-adhesive postage indicia labels 40 of the invention provided in a roll format 42. The postage indicia labels 40 are preferably placed on the roll 42 with one postage indicia label 40 per field 44, wherein each field is defined by separation lines 46, which separation lines 46 can comprise a printed line, a weakened line, perforations, serrations, holes, indentations and the like.

Figure 3B:
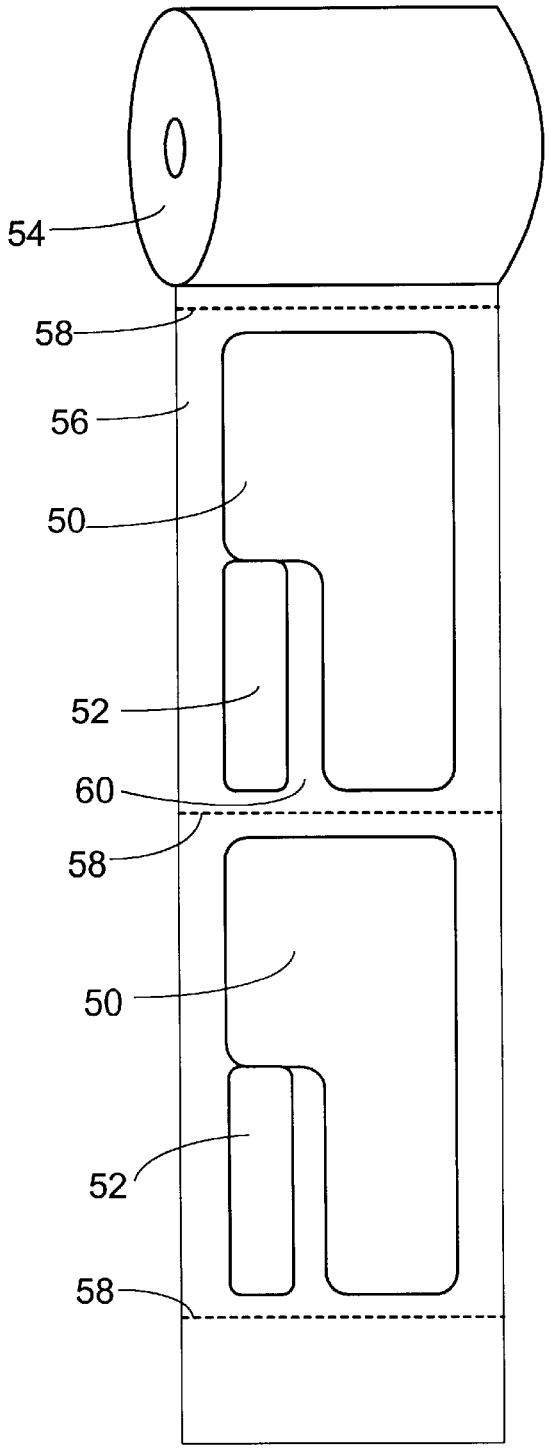
FIG. 3B is a top view of a fourth embodiment of unprinted self-adhesive label postage indicia labels of the invention in a roll format including postage indicia labels and sender labels.

Referring to FIG. 3B, there is shown a top view of a fourth embodiment of unprinted self-adhesive postage indicia labels 50 and sender labels 52 of the invention provided in a roll format 54. The postage indicia labels 50 are preferably placed on the roll 54 with one postage indicia label 50 per field 56, wherein each field is defined by separation lines 58, which separation lines 58 can comprise printed lines, weakened lines, perforations, serrations, holes, indentations and the like. The sender label 52 can be placed on the field in a relief area 60 of the postage indicia labels 50.

Postage indicia labels 40 and 50 and sender labels 52 provided in a roll format 42 and 54 are ideal for printing in a roll label style printer.

Figure 4:
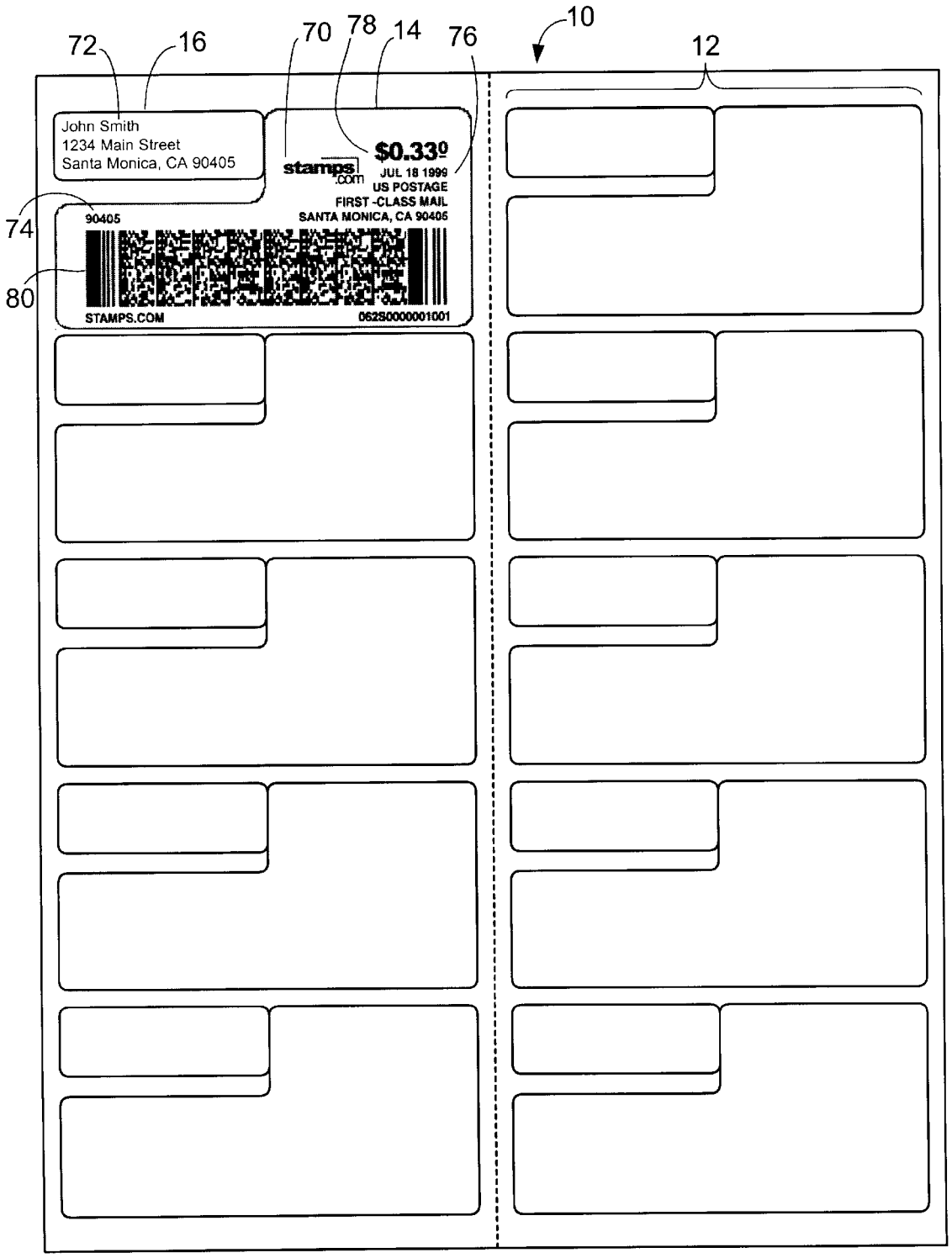
FIG. 4 is a plan view of the first embodiment of the sheet of self-adhesive labels with one set of the indicia label and a sender label printed with postage indicia presented in a first format and with sender information, respectively.

Turning to FIG. 4, there is shown a plan view of the first embodiment of the single sheet 10 of self-adhesive label sets 12 of the invention of FIG. 1, with postage indicia 70 printed on the postage indicia label 14 on the upper left hand corner of sheet 10 of labels. Optionally, sender information 72 may be printed on the sender label 16 on the upper left hand corner of sheet 10 of labels, and the sender label 16 can thereafter be applied to a mailpiece if desired. The postage indicium to be printed on the postage indicium label 14 includes new information 10 previously not included on postage indicium labels. This new information includes delivery information 74, namely, a human readable five digit destination zip, which can be located somewhere on the label, such as on an upper left hand corner of the larger lower rectangular portion 18 of postage indicium label 14, as well as destination information included in the 2D portion of the indicia 80. The postage indicium information further includes a human readable postage printing date 76 located below the human readable postage amount 78, as well as the 2D bar code 80 which includes this same information in a machine readable format. Since business courtesy envelopes are typically windowed to reveal a destination address or come preprinted with the destination address (not shown), the delivery information 74 on the postage indicium label takes the place of the ordinary requirement of printing a separate addressee label. Postage indicia labels in this format are to be printed on an "as needed" basis (e.g. when the mail piece is ready to be mailed out).

Figure 5:
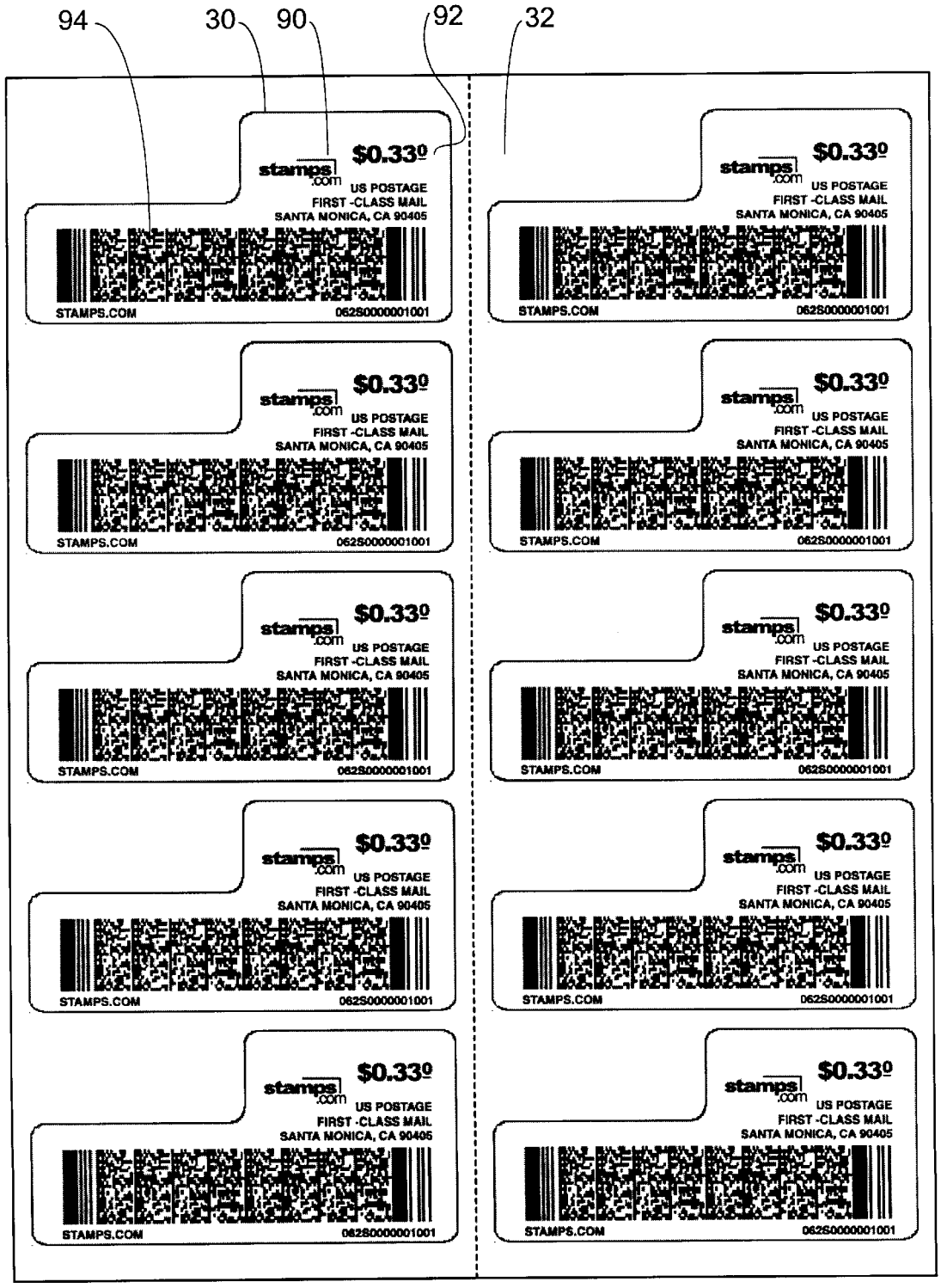
FIG. 5. is a plan view of a second embodiment of the sheet of self-adhesive labels printed with one of the postage indicia labels printed with postage indicia presented in a second format.

FIG. 5 is a plan view of the sheet 32 of self-adhesive postage indicia labels 30 of FIG. 2, with postage indicia 90 printed on the entire sheet of postage indicia labels 30. Unlike the postage indicium label of FIG. 4, in this style of printed postage indicia label 90, no date of mailing information is printed below the human readable dollar value 92 of the indicium or within 2D bar code portion 94 of the indicia. Furthermore, no destination point information appears in either a human readable form on the postage indicia 90 or within the 2D barcode portion 94 of the indicia. As shown, a plurality of postage indicia printed labels 90 can be printed in a batch (two or more) by the user on a sheet of labels 32, or even one at a time. After printing a number of the postage indicia printed labels 90, the user will then be able to apply the postage indicia printed labels 90 to a mailpiece as required.

Figure 6:
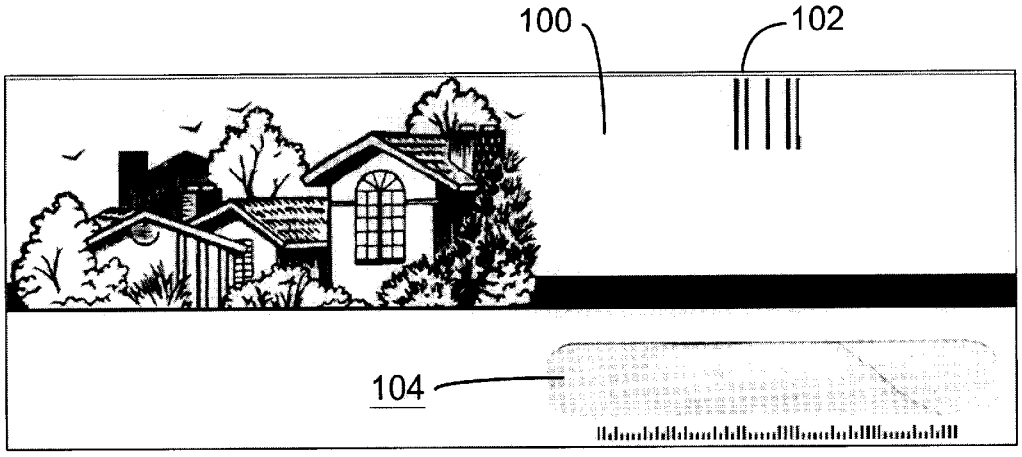
FIG. 6 is a plan view of a business courtesy envelope.

Turning to FIG. 6, there is shown an exemplary business courtesy envelope 100 with a FIM pattern 102. The business courtesy envelope 100 shown has a destination window 104, but could be pre-printed with the destination address.

Figure 7:
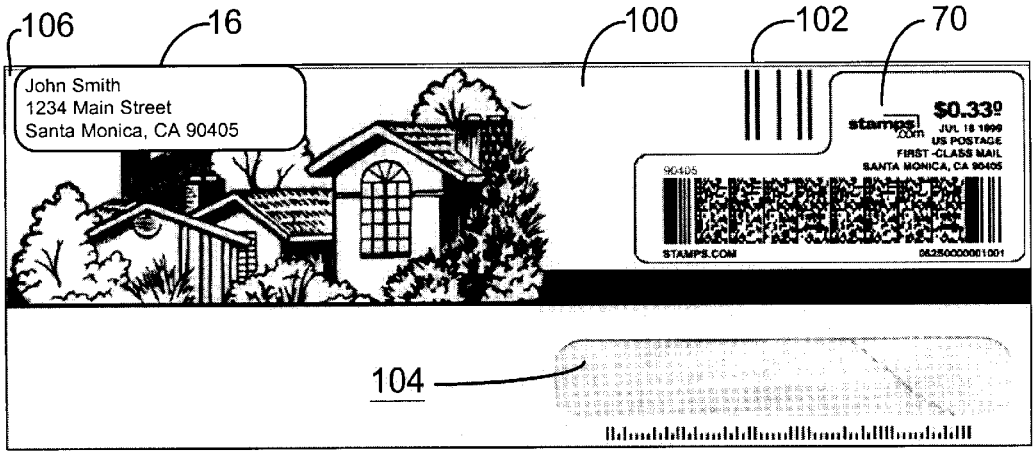
FIG. 7 is a plan view of a business courtesy envelope with the printed postage indicia label and sender label of FIG. 4 affixed thereto.

Turning to FIG. 7, the printed postage indicia label 70 is shown attached to the upper right hand corner of the envelope 100 of FIG. 6. The boot shape of the printed postage indicia label 70 avoids interfering with the FIM pattern 102 (or automated postage handling markings.) The user can attach the optional sender address label 16 to envelope 100 (e.g. to the upper left hand corner 106.)

Figure 8:
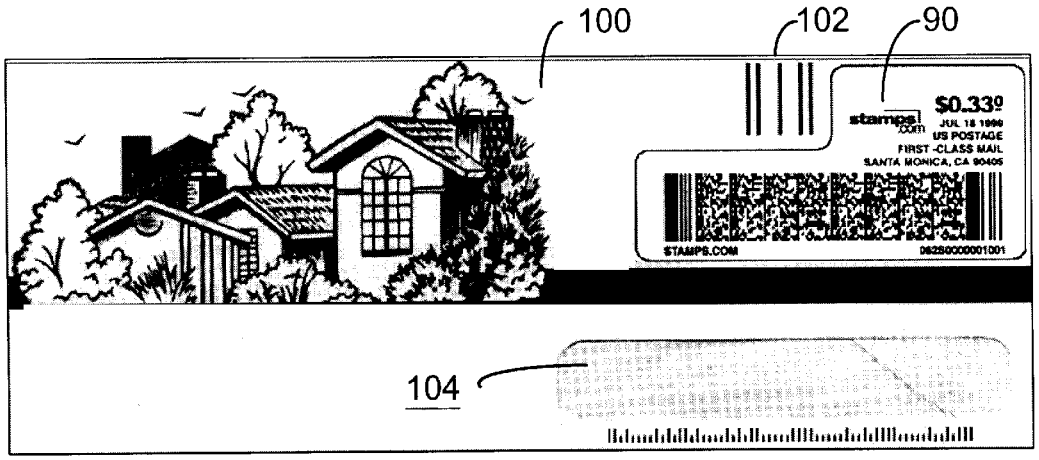
FIG. 8 is a plan view of a business courtesy envelope with a printed indicia label of FIG. 5 affixed thereto.

FIG. 8 is a plan view of the business courtesy envelope 100 of FIG. 6 with the printed postage indicia label 90 of FIG. 5 applied to the upper right hand corner of the envelope 100. Again, the postage indicium printed label 90 does not impinge on the FIM pattern 102 of the envelope 100 (or automated postage handling markings.)

Figure 9:
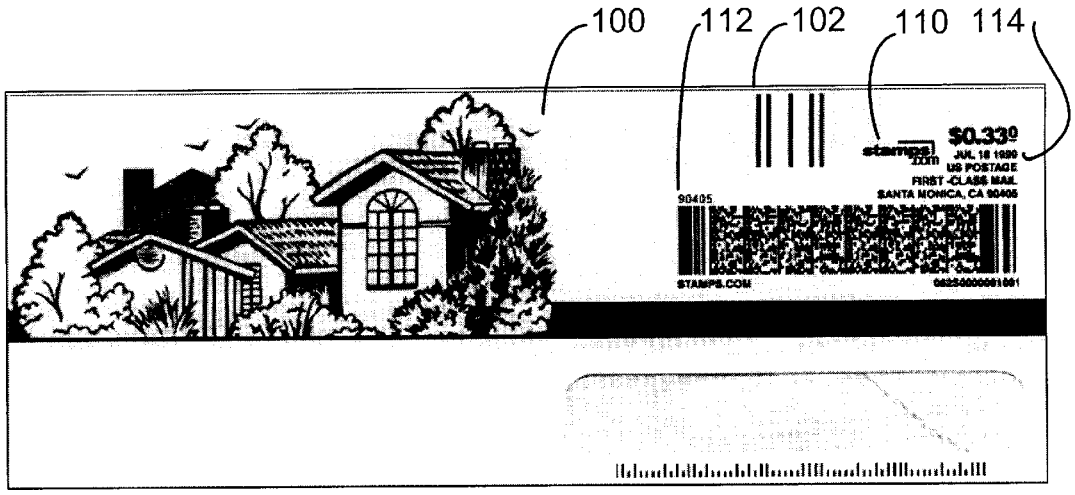
FIG. 9 is a plan view of a business courtesy envelope with postage indicia printed directly thereon.

Turning to FIG. 9, there is shown postage indicia 110 printed directly onto the upper right corner of the business courtesy envelope 100 of FIG. 6, which obviates the need for an indicia label. The postage indicia printed onto the envelope will take the form of the postage indicia 70 printed onto the postage indicia label 14 of FIG. 4, and will include destination information 112 and date of mailing information 114.

The construction of sheets 10, 32 and roll 42 of self-adhesive labels is conventional in that they include a backing sheet (not shown) with low adhesion from which labels can be detached and then permanently attached to the mailpieces.

The invention also provides a process for printing the special purpose label arrangement set with a postage indicia label and optionally a sender label in a single step.

Figure 10:
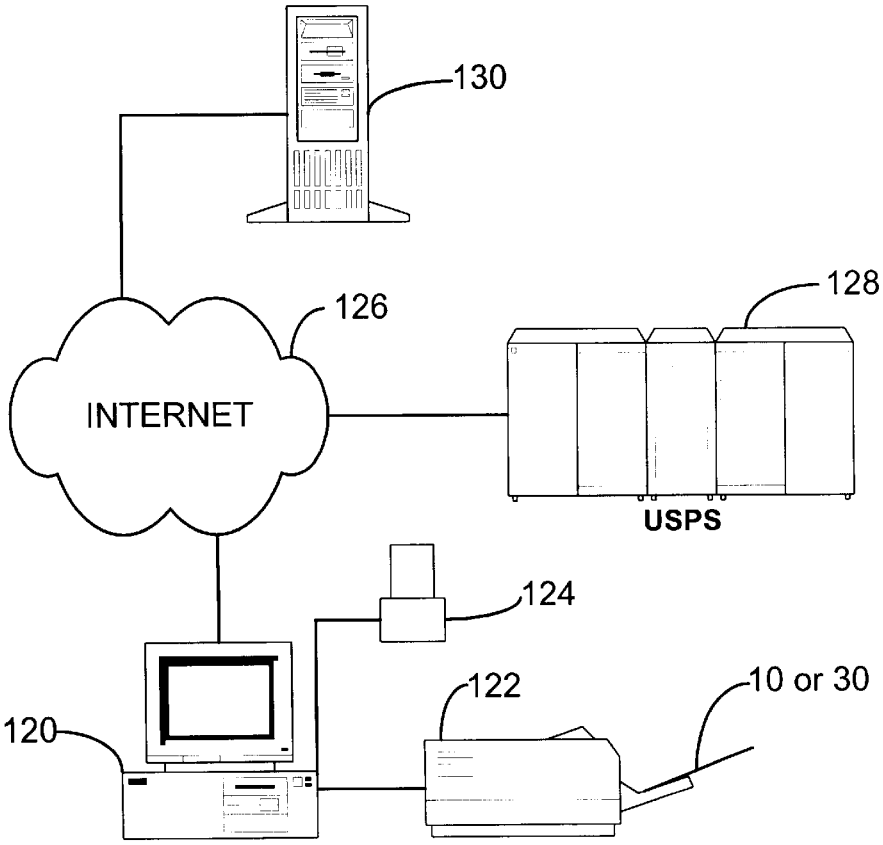
FIG. 10 is a diagrammatic view showing connection of the various portions of the system.

Referring to FIG. 10, there is depicted an embodiment of the method, wherein a user will provide a computer system 120 and a laser or ink jet sheet-type printer 122 and/or a roll type printer 124, and computer system 120 is to be connected to the a computer network, such as the Internet 126. A sheet of the labels 10 or 30 of the invention is feed into the sheet-type printer 122 and a roll of labels 42 or 54 is provided for the roll-type printer 124. A United States Postal Service Server 128 (or other national postal server for use of the method in foreign countries) is connected to a Internet Postage Server vendor, such 130 via the Internet 124.

Specialized computer software for printing the postage indicia on the postage indicia labels will be provided. For example, computer software such as described in U.S. patent application Ser. No. 09/163,993, filed on Sep. 29, 1998, by Mohan Ananda, entitled "On Line Postage System", assigned to Stamps.com, the assignee of the present invention, is incorporated by reference as if appearing as full herein. This specialized postage computer software program will preferably integrate with other computer software such as word processing, contact management, calendaring database, and accounting programs, to name a few, and will thus allow sharing of information, such as addressee information and account information. Postal value is obtained (e.g. from the Internet.)

This postage value can be obtained in blocks and stored on the user's computer or a device attached to the computer, or can be downloaded as needed (e.g. 33¢ at a time) . The user will indicate the style of label sheet being used (e.g. that of FIGS. 1, 2, 3A or 3B, or some other style of label sheet or roll) and the set number (e.g. top right set) to be printed. In another step, the user can optionally input the addressee information (e.g. from a document being typed, from information directly entered into the postage software, from the address book or database of another program, or in some other manner.) The correct postage value for the postage indicia label takes into consideration the sender's address, the destination address, the type of mail service to be used, and the weight and/or size of the postal piece being mailed. The user may wish to print a sender address label, which may be the sender's primary return address or some other address (e.g. an address for billing purposes, an address for customer service, etc.) Other information can also be printed onto the sender's label including, for example, a billing or account code. Some parts of the return address information, or other information identifying the user, such as origin zip code and origin city can be contained on the postage indicia label. Accordingly, there is a considerable amount of coordination required between the different data, the different software, and the label attributes in order to properly print the label sets. The specialized computer program will then direct the printer to print the postage indicia label, the addressee label, and the sender label of the correct set (e.g. the middle left set) of the special purpose label arrangement set, preferably in a single pass through the printer. The ordering of the above described steps is not critical, and could be varied.

With the invention, the user gains the ability to utilize business courtesy envelopes provided by the addressee. Depending upon the particular size of the business courtesy envelope (which are often size 9 envelopes for use in the U.S.A), the software can adjust the size and/or position of the postage indicia to be printed directly upon the envelope (in the case of the format of FIG. 9.) Likewise, the system of the invention would be suitable for use in foreign countries where automated postage handling markings are utilized.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

What is claimed is:

1. A roll of computer generated postage indicia mailing labels for business courtesy mailings pre-printed with a FIM pattern, comprising:

a roll of postage indicia labels with one postage indicia label being located per field, each postage indicia label having a wider lower region and a narrower upper region, with the upper region being oriented to a right side of the postage indicia label and leaving a relief area on an upper left side area of the postage indicia label, the indicia label being sized and shaped for attachment to an upper right hand corner of a mail piece bearing a FIM pattern and having a FIM clear zone in such a manner so as not to encroach on the FIM pattern, wherein each field is defined by separation lines defining a plurality of fields, wherein the separate postage indicia label is adapted to be affixed to an item to be mailed, the strip being adapted for use with a computer driven printer wherein the printer is adapted to print postal service approved postage indicia on the postage label in a preselected field.

2. The roll of computer generated postage indicia mailing labels for business courtesy mailings of claim 1, wherein each field of labels further comprises a sender label on which a return address of a sender is printed by the computer driven printer.

3. A process for printing, for business courtesy mail envelopes pre-printed with FIM patterns or automated postage handling markings, postage indicia and sender information onto a roll containing at least one special purpose label arrangement set, the process comprising:

providing a computer system and a printer, the computer system;

providing at least one set of computer printer printable special purpose label arrangement sets provided on a roll of label sets, each label set being provided on a field of the roll, each field being defined by separating lines, each label set having a postage indicia label and a sender label, the postage indicia label having a wider lower region and a narrower upper region, with the upper region being oriented to a right side of the postage indicia label and sized and shaped for attachment to an upper right hand corner of an envelope bearing a FTM pattern and having a FIM clear zone in such a manner so as not to encroach on the FTM pattern;

providing a postage computer program adapted for use by the computer system and printer for preparing and printing postage indicia and sender information onto the postage indicia label and sender label, respectively;

inputting into the postage computer program information concerning the sender;

inputting into the postage computer program information concerning the mail piece to be mailed; and directing the postage computer program to print the postage indicia and sender information onto the postage indicia label and the sender label, respectively, wherein when the postage indicia label is applied to the business courtesy envelope, the FIM pattern or the automated postage handling markings of the business courtesy envelope will not be covered up.

4. The process of claim 3, where a plurality of postage indicia labels are printed in a single pass through the printer.

5. The process of claim 3, wherein the postage indicia printed on the postage indicia label does not include postage date information.

6. The process of claim 3, wherein the label sets do not include an addressee label.

7. The process of claim 6, wherein the postage indicia printed on the postage indicium label includes destination information.

8. The process of claim 7, wherein the destination information comprises a destination zip code in both a human readable format and in a 2D barcode format.

9. The process of claim 3, further comprising the step of obtaining postage value from a postage server.

10. The process of claim 3, wherein the computer system is connected to the postage server through a computer network.

11. A process for printing, for business courtesy mail envelopes pre-printed with FIM patterns or automated postage handling markings, postage indicia onto a roll containing at least one special purpose label arrangement set, the process comprising:

providing a computer system and a printer;

providing at least one set of computer printer printable self-adhesive special purpose label arrangement sets provided on a roll of label sets, each label set being provided on a field of the roll, each field being defined by separating lines, each label set having a postage indicia label, the postage indicia label having a wider lower region and a narrower upper region, the lower and upper being continuous, with the upper region being oriented to a right side of the postage indicia label and sized for attachment to an upper right hand corner of an envelope bearing a FIM pattern and having a FIM clear zone in such a manner so as not to encroach on the FIM pattern;

providing a postage computer program adapted for use by the computer system and printer for preparing and printing postage indicia onto the postage indicia label;

inputting into the postage computer program information concerning the mail piece to be mailed; and directing the postage computer program to print the postage indicia onto the postage indicia label, wherein when the postage indicia label is applied to the business courtesy envelope, the FIM pattern or the automated postage handling markings of the business courtesy envelope will not be covered up.

12. The process of claim 11, further comprising the step of inputting into the postage computer program information concerning the addressee.

13. The process of claim 11, wherein a plurality of postage indicia labels are printed in a single pass through the printer.

14. The process of claim 11, wherein the postage indicia printed on the postage indicia label does not include postage date information.

15. The process of claim 11, wherein the label sets do not include an addressee label.

16. The process of claim 11, wherein the postage indicia printed on the postage indicium label includes destination information.

17. The process of claim 16, wherein the destination information comprises a destination zip code in both a human readable format and in a 2D barcode format.

18. The process of claim 11, further comprising the step of obtaining postage value from a postage server.

19. The process of claim 11, wherein the computer system is connected to the postage server through a computer network.

20. A process for printing postage indicia directly onto business courtesy mail envelopes that are pre-printed with a FIM pattern or automated postage handling markings, the process comprising:

providing a computer system and a printer;

providing a postage computer program adapted for use by the computer system and printer for preparing and printing postage indicia directly onto the business courtesy mail envelopes;

inputting into the postage computer program information concerning the mail piece to be mailed;

inputting into the postage computer program information concerning the destination; and directing the postage computer program to print the postage indicia including destination information incorporated therein directly onto the business courtesy envelope such that the postage indicia will not be printed to overlay the FIM pattern or the automated postage handling markings of the business courtesy envelope.

* * * * *